US009237795B2

(12) United States Patent
Hollis

(10) Patent No.: US 9,237,795 B2
(45) Date of Patent: Jan. 19, 2016

(54) COLLAPSIBLE BEVERAGE CUP

(76) Inventor: John Rey Hollis, Berkeley, CA (US)

( * ) Notice: Subject to any disclaimer, the term of this patent is extended or adjusted under 35 U.S.C. 154(b) by 775 days.

(21) Appl. No.: 13/312,928

(22) Filed: Dec. 6, 2011

(65) Prior Publication Data

US 2013/0140305 A1 Jun. 6, 2013

(51) Int. Cl.

| | |
|---|---|
| ***B65D 6/00*** | (2006.01) |
| ***A45F 3/20*** | (2006.01) |
| ***B65D 21/08*** | (2006.01) |
| ***B65D 33/02*** | (2006.01) |
| *B65D 25/08* | (2006.01) |

(52) U.S. Cl.

CPC ..... *A45F 3/20* (2013.01); *B65D 21/086* (2013.01); *B65D 33/02* (2013.01); *A45F 2003/205* (2013.01); *B65D 25/08* (2013.01)

(58) Field of Classification Search

CPC ..... B65D 21/086; B65D 33/02; A45F 3/20; A45F 2003/205

USPC ..... 220/4.33, 6, 7, 8, 9.2, 9.4, 666, 904; 215/395, 900

See application file for complete search history.

(56) References Cited

U.S. PATENT DOCUMENTS

| | | | | |
|---|---|---|---|---|
| 1,025,380 | A | 5/1912 | Curtis et al. | |
| 1,228,706 | A * | 6/1917 | Smythe | 220/8 |
| 1,356,995 | A * | 10/1920 | Mayer | 220/6 |
| 1,426,916 | A | 8/1922 | Schorpp | |
| 1,530,256 | A * | 3/1925 | Garland | 220/743 |
| 1,690,586 | A | 11/1928 | Main et al. | |
| 2,234,065 | A | 3/1941 | Vogt | |
| 2,382,573 | A | 8/1945 | Moore | |
| 2,853,222 | A * | 9/1958 | Gallagher | 229/402 |
| 3,003,678 | A | 10/1961 | Chase | |
| 3,136,475 | A | 6/1964 | Geimer | |
| 3,184,149 | A | 5/1965 | Repko | |
| 3,285,459 | A | 11/1966 | Gahin | |
| 3,363,750 | A | 1/1968 | Smith | |
| 3,372,859 | A | 3/1968 | Johansson | |
| 3,373,917 | A | 3/1968 | Cox | |
| 3,375,969 | A | 4/1968 | Davis | |
| 3,437,258 | A | 4/1969 | Kiigler | |
| 3,521,807 | A | 7/1970 | Weisberg | |
| 3,565,244 | A | 2/1971 | Wakefkld | |
| 3,604,491 | A | 9/1971 | Spiess | |
| 3,640,381 | A | 2/1972 | Kanada et al. | |
| 3,659,777 | A | 5/1972 | Kanada et al. | |
| 3,684,156 | A | 8/1972 | Fettinger et al. | |
| 3,684,157 | A | 8/1972 | Mendez et al. | |
| 3,939,887 | A | 2/1976 | Scarnato | |
| 4,196,034 | A | 4/1980 | Kimura | |
| 4,257,535 | A | 3/1981 | Mellett | |

(Continued)

*Primary Examiner* — Fenn Mathew
*Assistant Examiner* — Robert Stodola
(74) *Attorney, Agent, or Firm* — Bay Area Technology Law Group PC

(57) ABSTRACT

A collapsible beverage cup and method for its use. The beverage cup is provided with a body portion capable of lying flat in a first state and capable of assuming the shape of a beverage cup in a second state. In its first state, the collapsible beverage cup is substantially two dimensional and planar having a relatively rigid outer shell having a first edge, second edge and boundary edges joining said first and second edges, the collapsible beverage cup further comprising an inner liner for retaining a beverage therein when said collapsible beverage cup is in its second state and a loop, preferably in the shape of a round ring, sized to slide onto the outer shell and releasably maintain the collapsible beverage cup in its second state.

12 Claims, 4 Drawing Sheets

(56) References Cited

U.S. PATENT DOCUMENTS

| | | | | | |
|---|---|---|---|---|---|
| 4,284,205 | A | | 8/1981 | Hirata | |
| 4,391,366 | A | | 7/1983 | Hirata | |
| 4,408,644 | A | | 10/1983 | Svantesson | |
| 4,428,500 | A | * | 1/1984 | Kohler | 229/117 |
| 4,491,220 | A | * | 1/1985 | Daviss | 206/217 |
| 4,530,480 | A | | 7/1985 | Pratt | |
| 4,620,631 | A | * | 11/1986 | Bartelt | 206/217 |
| 4,792,086 | A | * | 12/1988 | Chen | 229/117 |
| 4,854,474 | A | | 8/1989 | Murray et al. | |
| 4,867,374 | A | | 9/1989 | Murray et al. | |
| 4,895,135 | A | | 1/1990 | Hamasaki | |
| 4,940,138 | A | | 7/1990 | Hornstein | |
| 4,941,754 | A | | 7/1990 | Murdock | |
| 5,101,996 | A | | 4/1992 | Mosley | |
| 5,132,124 | A | | 7/1992 | Tamaki et al. | |
| 5,188,261 | A | | 2/1993 | Butters | |
| 5,213,253 | A | | 5/1993 | Fantoni et al. | |
| 5,244,108 | A | * | 9/1993 | Hale | 220/4.33 |
| 5,255,808 | A | | 10/1993 | Tobler | |
| D345,673 | S | | 4/1994 | Dark | |
| 5,460,324 | A | | 10/1995 | Vinther | |
| 5,478,152 | A | | 12/1995 | Bogle | |
| 5,575,398 | A | | 11/1996 | Robbins, III | |
| D381,558 | S | | 7/1997 | Schaefer et al. | |
| 5,842,634 | A | | 12/1998 | Kieler | |
| 6,126,010 | A | | 10/2000 | Kogen | |
| 6,227,439 | B1 | | 5/2001 | Hansen | |
| 6,260,756 | B1 | | 7/2001 | Mochizuki et al. | |
| 6,508,587 | B1 | | 1/2003 | Byers, Jr. | |
| 6,527,169 | B2 | | 3/2003 | Kim | |
| 6,666,329 | B1 | | 12/2003 | Charbonneau | |
| 6,702,143 | B2 | | 3/2004 | Wang | |
| 6,736,285 | B2 | | 5/2004 | Stewart-Stand | |
| 7,128,934 | B1 | | 10/2006 | Ohta et al. | |
| 7,347,623 | B2 | | 3/2008 | Cawley | |
| D580,799 | S | | 11/2008 | Curtin | |
| 7,604,155 | B2 | | 10/2009 | Bossel et al. | |
| 7,757,881 | B1 | * | 7/2010 | Riley | 220/483 |
| 2003/0160055 | A1 | | 8/2003 | Stewart-Stand | |
| 2005/0103834 | A1 | * | 5/2005 | Cousins | 229/402 |
| 2008/0035715 | A1 | * | 2/2008 | Abler | 229/93 |
| 2010/0019006 | A1 | * | 1/2010 | Van Art | 224/148.2 |
| 2010/0230407 | A1 | * | 9/2010 | Savage | 220/9.4 |

* cited by examiner

COLLAPSIBLE BEVERAGE CUP

TECHNICAL FIELD

The present invention involves a collapsible beverage cup capable of lying flat in a first state and assuming the shape of a beverage cup in its second state. Thus, the present invention facilitates ease of portability while being available to a user at any time for retaining a beverage.

BACKGROUND OF THE INVENTION

There are certainly collapsible cups which, although convenient in concept, have not been widely adopted commercially. This is primarily due to the fact that, oftentimes, collapsible cups, when folded, are incapable of remaining in their collapsed or foldable state thus creating unwanted volume during transport. Other such products, when unfolded, tend to collapse or tip causing spillage or instability. In either case, such foldable products tend to be much less desirable than their permanent or nonfoldable counterparts.

For a collapsible beverage cup to be a commercial success, it must be capable of converting from a two dimensional or flat configuration to a three dimensional beverage containing configuration and back again conveniently. It also must be fully stable and capable of containing a beverage and dispensing it in a manner substantially equivalent to its noncollapsible counterpart. Finally, as a preferred embodiment, the cup must be closable to prevent foreign debris from intruding into its interior when not in use as well as preventing residual moisture that may remain within the liner from leaking into a user's pocket or purse while enabling the cup to reside upon a flat surface during beverage containment.

These and further objects will be readily apparent when considering the following disclosure and appended claims.

SUMMARY OF THE INVENTION

A collapsible beverage cup and method for its use. The beverage cup is provided with a body portion capable of lying flat in a first state and capable of assuming the shape of a beverage cup in a second state. In its first state, the collapsible beverage cup is substantially two dimensional and planar having a relatively rigid outer shell having a first edge, second edge and boundary edges joining said first and second edges, the collapsible beverage cup further comprising an inner liner for retaining a beverage therein when said collapsible beverage cup is in its second state and a loop, preferably in the shape of a round ring, sized to slide onto the outer shell and releasably maintain the collapsible beverage cup in its second state.

DETAILED DESCRIPTION OF THE INVENTION

Figure 1:
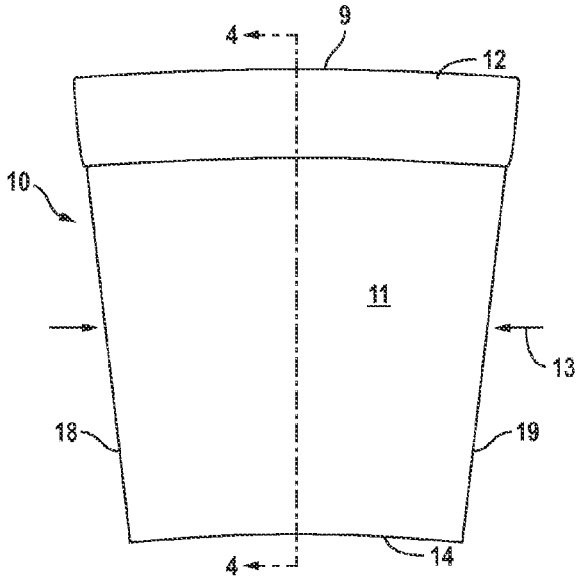
FIG. 1 is a side view of the present invention in its first state as a flat or planar object.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, collapsible beverage cup 10 is shown having a body portion in the form of an outer shell composed of front and back segments 11 and 15 (FIG. 4) joined at boundary edges 18 and 19. Collapsible beverage cup 10 is shown in FIG. 1 in its first state lying flat while capable of assuming the shape of a beverage cup in its second state, the later depicted in FIG. 3.

Turning again to FIG. 1, when in its first state, collapsible beverage cup 10 is substantially two dimensional and planar having a relatively rigid outer shell composed of subparts 11 and 15, first edge 14, second edge 9 and boundary edges 18 and 19 joining said first and second edges. An inner flexible liner 12 is also provided which, ideally, forms a lip over second edge 9 and creates a beverage retaining membrane within the substantially rigid body portion thereof.

Figure 3:
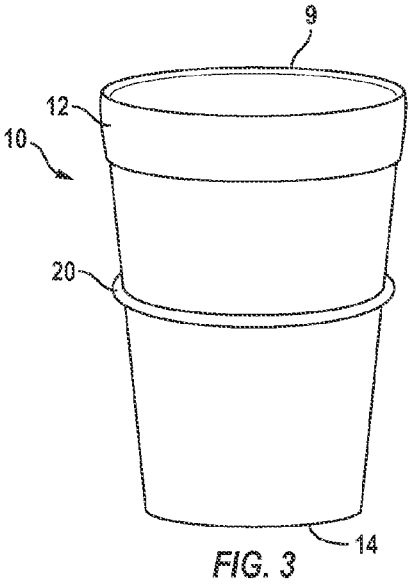
FIG. 3 is a side perspective view of the collapsible beverage cup of the present invention once the cup of FIG. 1 has been expanded and held in position through the use of the loop of FIG. 2.
Figure 4:
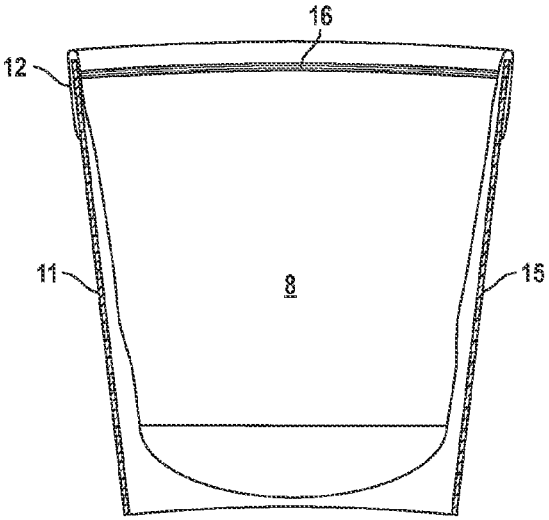
FIG. 4 is a cross sectional view of the present invention taken along line 4-4 of FIG. 1.

In order to transition from a first or planar state to a second three dimensional state, one would press inwardly against boundary edges 18 and 19 in the direction shown by arrows 13. Importantly, in order to maintain the cup configuration as shown in FIG. 3, it is contemplated that loop 20, having a diameter larger than the diameter of collapsible beverage cup 10 at its first edge but smaller than its diameter at its second edge, is slid onto collapsible beverage cup 10 at its first edge and is moved upwardly until it frictionally maintains itself on the outer shell preventing boundary edges 18 and 19 from moving outwardly and thus preventing collapsible beverage cup 10 from inadvertently returning to its first or planar state.

It is further contemplated, as a preferred embodiment, that zip lock connector 16 be configured within inner liner 12 proximate second edge 9. Thus, once a user wishes to return collapsible beverage cup 10 from its second or three dimensional configuration shown in FIG. 3 to its first or planar state shown in FIG. 1, loop 20 would be caused to slide downwardly in the direction of first edge 14 followed by drawing outer shell segments 11 and 15 toward one another. The bead and track segments of zip lock connector 16 are then engaged preventing foreign matter and unwanted debris from entering inner volume 8 while being stored or transported as well as preventing residual moisture that may remain within the liner from leaking into a user's pocket or purse. Oftentimes zip lock connectors, such as those commonly employed to store food products in clear plastic storage bags, can be opened by applying thumb and forefinger pressure against boundary edges 18 and 19 in the direction of arrows 13. If not, segments 11 and 15 can be pried apart with mere finger pressure resulting in the opening of the cup's inner volume. Closure is made by applying pressure proximate second edge 9 by running one's thumb and forefinger along the bead and track of zip lock connector 16.

Figure 5:
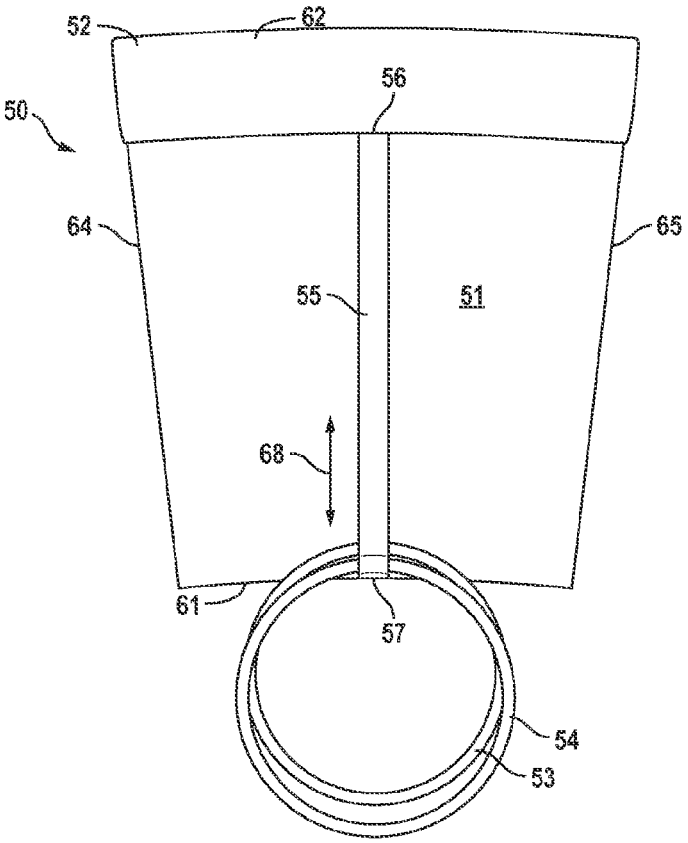
FIG. 5 is a side view of a second embodiment of the collapsible beverage cup of the present invention shown in its first state, that is, as a collapsed, two dimensional object.
Figure 6:
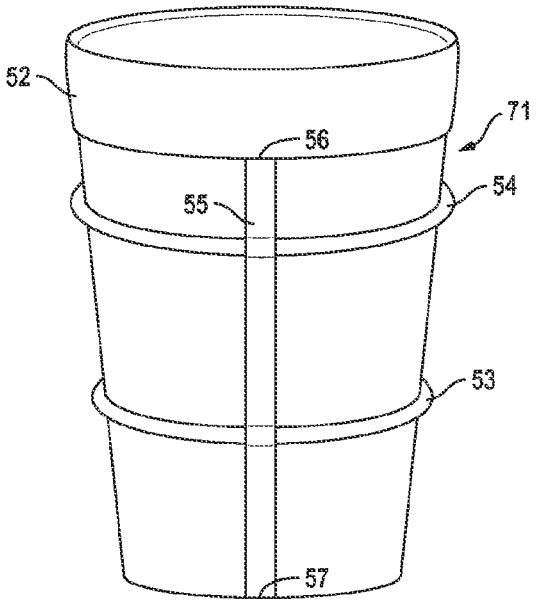
FIG. 6 is a side perspective view of the beverage cup of FIG. 5 in its second state as a three dimensional object capable of accepting and retaining a beverage therein.

As a second embodiment of the present invention, reference is made to FIGS. 5 and 6. In doing so, one is reminded that in practicing the embodiment of FIGS. 1, 2 and 3, loop 20 is introduced as a standalone element which is kept separate and apart from the body of the collapsible beverage cup. As a result, loop 20 could conceivably be lost or otherwise disassociated with the cup.

In order to address this issue, collapsible beverage cup 50 is shown supporting loop retainer 55 in the form of a substantially elongated strip secured at ends 56 and 57 proximate first and second edges 61 and 62. As was the case with the embodiment of FIGS. 1, 2 and 3, collapsible beverage cup 50 likewise is provided with an outer shell having front segment 51, the back segment of which not being visible but being identified as element 71 (FIG. 6). Liner 52 is employed in a similar fashion as liner 12. As with the first embodiment, a user would transition from the first or planar orientation of FIG. 5 to the three dimensional, second orientation of FIG. 6, by placing inward pressure on boundary edges 64 and 65 followed by passing loops 53 and 54 in the direction of arrow 68. Further, it is noted that the diameter of loop 53 is greater than the diameter of the collapsible beverage cup at first end 61 but smaller than the diameter of collapsible beverage cup 50 at second edge 62. Likewise, loop 53 is sized with the same constraints but further noting that the diameter of loop 54 is greater than the diameter of loop 53 to enable loops 53 and 54 to be frictionally maintained along collapsible beverage cup 50 at different distances from the top and bottom edges thereof.

Figure 2:
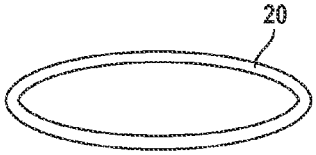
FIG. 2 is a perspective view of a loop, preferably in the shape of a round ring, useable in maintaining the present collapsible beverage cup in its second state as shown in FIG. 3.

As was the case with the embodiment shown in FIGS. 1-3, beverage cup 50 can transition from its second or three dimensional state shown in FIG. 6 to its first or two dimensional state shown in FIG. 5 by applying inward pressure to boundary edges 64 and 65 while sliding loops 53 and 54 downwardly along the outer shell of the cup to a point where they are completely released therefrom. Outer shell segments 51 and 71 would naturally somewhat collapse although further urging can be accomplished by placing mere thumb and forefinger pressure on the outer shell segments 51 and 71 followed by optional engagement of an appropriate zip lock fastener, again, positioned proximate top edge 62.

It should be apparent that the present invention provides a collapsible beverage cup which, in its first or planar condition, can be easily carried in a trouser pocket, briefcase, purse or the like and readily converted into a second state having a cup-shaped configuration capable of receiving and retaining a liquid within an impervious liner. Further noting that because first edge 14/61 is linear, the collapsible beverage cup of the present invention is made to reside upon a planar surface. Further, the liner is sized to extend within its sidewalls but not below the first edge thereof.

Figure 7:
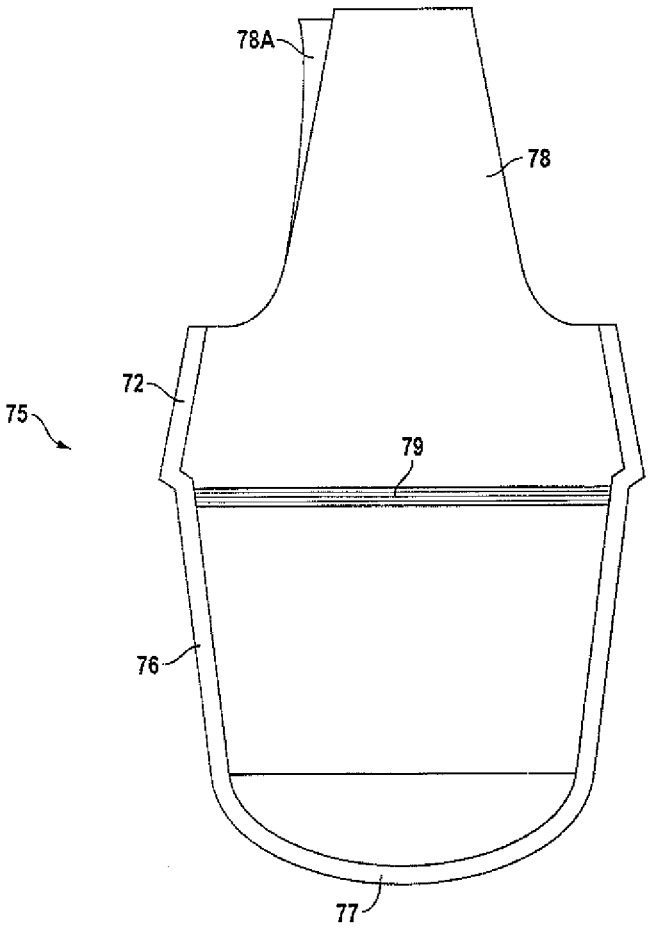
FIG. 7 is a partial cross sectional plan view of a preferred liner used in practicing the present invention.

In turning to FIG. 7, a cross-sectional view of a preferred liner for use herein is depicted. Specifically, liner 75 includes sidewall 76 intended to somewhat parallel front and back segments 11 and 15 of cup 10, segments 51 and 71 of cup 50 or sidewall 81 of cup 80. Sidewall 76 is closed by round bottom gusset 77 which, when installed within the cup extends near but not beyond its bottom edge. As in previous embodiments, as a preferred embodiment, zip lock connector 79 is included beneath the lip of the cup and liner segment 72 terminating in tail sections 78 and 78A. Use of liner 75 can be most appreciated when viewing FIGS. 8A and 8B.

Figure 8A:
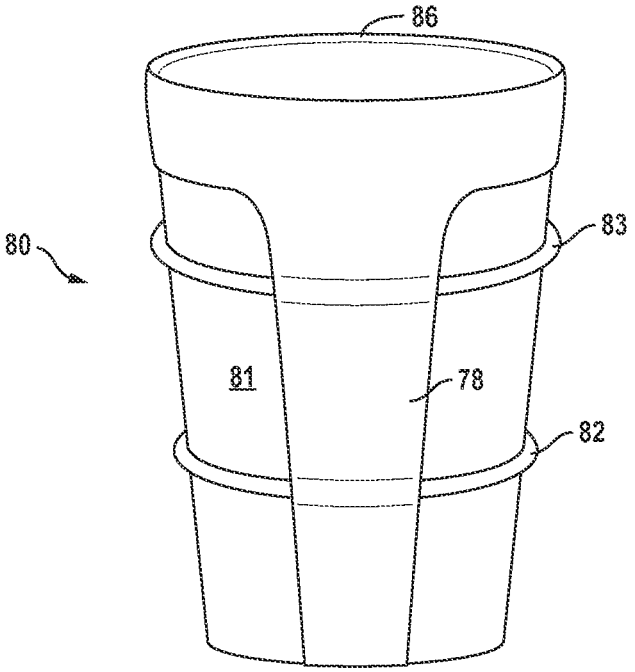
FIGS. 8A and 8B are perspective views of yet another embodiment of the present invention.
Figure 8B:
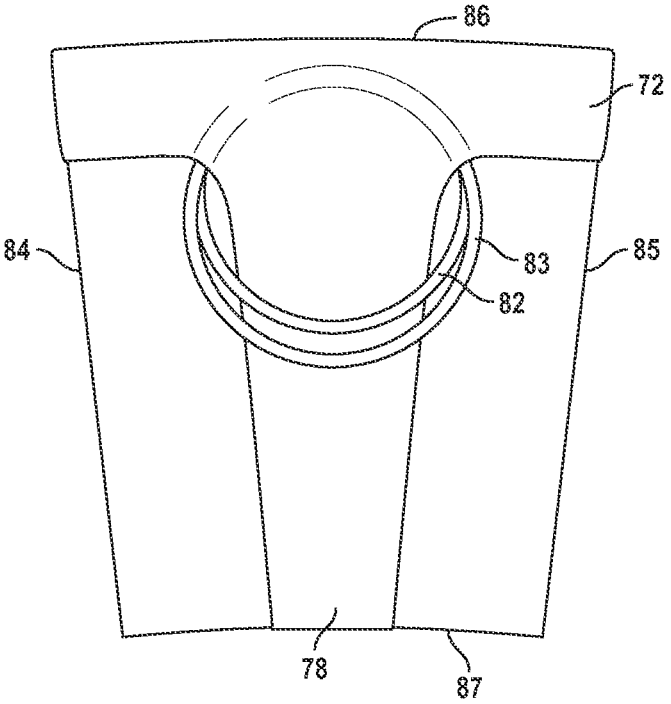

Turning first to FIG. 8A, cup 80 is shown in its three dimensional orientation having loops 82 and 83 secured to maintain that orientation as desired. Cup 80 differs from the previous embodiments by extending tail sections 78 from liner 75 over the lip 86 of cup 80 being secured on an inner portion of sidewall 81 wrapping around bottom edge 87 as shown. In doing so, liner segment 72 passes over top edge 86 allowing zip lock connector 79 (FIG. 7) to reside just below edge 86. As further noted, liner 75 as being fixed to an inner part of sidewall 81 creates loop retainers for facilitating the sliding of loops 82 and 83 from their cup retaining orientations of FIG. 8A to their storage orientations of FIG. 8B.

As in the previous embodiments, cup 80 can be collapsed into a substantially two dimensional configuration (FIG. 8B) by pressing against the sides of cup 80 between boundary edges 84 and 85. Loops 82 and 83 are then slid down the space created between cup sidewall 81 and tail section 78 and, once collapsed, the loops can be tucked beneath segment 72 of liner 75 as shown. Thereupon, zip lock connector 79 can be urged to close the inner volume of cup 80 by sliding one's thumb and forefinger on the outside of sidewall 81 between boundary edges 84 and 85 as one would do to close any typical zip lock connector of the prior art.

It should also be readily apparent that the present invention could be configured in other permissible ways while remaining within the spirit and scope of the present invention. For example, applicant has shown, by way of example, the use of a single detachable loop (FIG. 2) or two loops maintained by a retainer along the outer shell of the collapsible beverage cup itself. However, any number of loops can be employed either attached to the cup or held separately therefrom. Applicant has also depicted loops being of a solid ring-like configuration. However, alternative loops could be used which are hinged to enable them to open and close or be somewhat elastic enhancing their ability to be retained on the cup. Such loops could be circular, oval or have varying geometries to enable them to perform as intended.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A collapsible beverage cup having a body portion capable of lying flat in a first state and capable of assuming the shape of a beverage cup in a second state, wherein in said first state, said collapsible beverage cup is substantially two dimensional and planar having a relatively rigid outer shell having a first edge, second edge and boundary edges joining said first and second edges, said collapsible beverage cup further comprising an inner liner for retaining a beverage therein when said collapsible beverage cup is in said second state and a loop sized to slide onto said outer shell and releasably maintain said collapsible beverage cup in said second state.

2. The collapsible beverage cup of claim 1 wherein when said outer shell is in said second state, said first edge is substantially circular having a first diameter and said second edge is substantially circular having a second diameter and said loop is substantially circular having a diameter smaller than the diameter of said outer shell at said second edge and greater than the diameter of said outer shell at said first edge.

3. The collapsible beverage cup of claim 1 further comprising a zip lock connector on said inner liner positioned proximate said second edge.

4. The collapsible beverage cup of claim 1 comprising a plurality of loops.

5. The collapsible beverage cup of claim 4 wherein said plurality of loops are each substantially circular and each of different diameters.

6. The collapsible beverage cup of claim 1 further comprising a loop retainer positioned on said outer shell, said loop retainer being secured to said outer shell, said loop retainer facilitating the sliding of said loop along said outer shell between said loop retainer and outer shell.

7. The collapsible beverage cup of claim 4 further comprising a loop retainer positioned on said outer shell, said loop retainer being secured to said outer shell, said loop retainer facilitating the sliding of said plurality of loops along said outer shell between said loop retainer and outer shell.

8. The collapsible beverage cup of claim 6 wherein said loop retainer comprises a substantially elongated strip secured proximate the first and second edges of said outer shell.

9. The collapsible beverage cup of claim 1 wherein said first edge is substantially linear for enabling said collapsible beverage cup to reside upon a planar surface on said first edge when said collapsible beverage cup is in its second state.

10. A method of converting a substantially two dimensional portable object into a three dimensional beverage cup, said two dimensional portable object having a body portion capable of lying flat in a first state and capable of assuming the shape of a beverage cup in a second state, such that when in said first state, said portable object is substantially two dimensional and planar having a relatively rigid outer shell having a first edge, second edge and boundary edges joining said first and second edges, said two dimensional portable object further comprising an inner liner for retaining a beverage therein and further comprising a loop sized to slide onto said outer shell and releasably maintain said collapsible beverage cup in said second state, said method comprising applying inward pressure against said boundary edges and sliding said loop along said boundary edges until said loop remains frictionally secure thereto.

11. The method of claim 10 further comprising converting said beverage cup to a substantially two dimensional portable object, said method comprising sliding said loop from said boundary edges followed by applying inward pressure against said relatively rigid outer shell.

12. A collapsible beverage cup having a body portion capable of lying flat in a first state and capable of assuming the shape of a beverage cup in a second state, wherein in said first state, said collapsible beverage cup is substantially two dimensional and planar having a relatively rigid outer shell having a first edge, second edge and boundary edges joining said first and second edges, said collapsible beverage cup further comprising an inner liner for retaining a beverage therein when said collapsible beverage cup is in said second state and a loop sized to slide onto said outer shell and releasably maintain said collapsible beverage cup in said second state, said inner liner being characterized as comprising a pair of tail sections sized to extend beyond the length of said boundary edges, said tail sections positioned on said outer shell forming loop retainers facilitating the sliding of said loop along said outer shell between said tail sections and outer shell.

* * * * *